US006644164B1

(12) United States Patent
Stroud

(10) Patent No.: US 6,644,164 B1
(45) Date of Patent: Nov. 11, 2003

(54) ROTATABLE SAW UNIT FOR OPTIMIZED LOG BREAKDOWN

(76) Inventor: Brian T. Stroud, P.O. Box 8, 3550 - 45th Street, S.E., Salmon Arm, British Columbia (CA), V1E 4N2

( * ) Notice: Subject to any disclaimer, the term of this patent is extended or adjusted under 35 U.S.C. 154(b) by 189 days.

(21) Appl. No.: 09/639,823

(22) Filed: Aug. 17, 2000

(51) Int. Cl.[7] ..... B27C 9/00; B26D 5/20; B27B 25/00; B27B 1/00; B27B 13/00

(52) U.S. Cl. ..... 83/811; 83/75.5; 83/76.8; 83/364; 83/368; 83/367; 83/789; 144/378; 144/357; 144/39

(58) Field of Search ..... 83/75.5, 76.8, 83/76.9, 364, 365, 368, 370, 371, 426, 425.2, 433, 435.2, 436.15, 789, 810, 811, 812; 144/358, 382, 356, 378

(56) References Cited

U.S. PATENT DOCUMENTS 357,681 A * 2/1887 Maxwell ..... 83/410
4,316,491 A * 2/1982 Kearnes et al. ..... 144/357
4,579,026 A * 4/1986 Tsune ..... 83/13
4,665,786 A * 5/1987 Shields ..... 83/364
4,947,909 A * 8/1990 Stroud ..... 144/357
5,243,888 A * 9/1993 Bowlin ..... 83/76.8
5,722,474 A * 3/1998 Raybon et al. ..... 144/357
6,062,281 A 5/2000 Dockter et al.
6,202,526 B1 * 3/2001 Dockter et al. ..... 83/76.8

* cited by examiner

*Primary Examiner*—Boyer D. Ashley
(74) *Attorney, Agent, or Firm*—Antony C. Edwards

(57) ABSTRACT

A rotatable saw unit for optimized log breakdown includes a saw unit immediately downstream of an infeed conveyor and cooperating with the infeed conveyor for sawing a workpiece as the workpiece is translated by the infeed conveyor into the saw unit. The saw unit includes at least one saw aligned for sawing of the workpiece parallel to a longitudinal infeed axis. An optimizing processor determines an optimized sawing orientation relative to the longitudinal infeed axis. A saw unit positioner'selectively rotates the saw unit about a saw unit rotation axis so as to rotate the at least one saw into the optimized sawing orientation prior to sawing of the workpiece.

14 Claims, 5 Drawing Sheets

ROTATABLE SAW UNIT FOR OPTIMIZED LOG BREAKDOWN

FIELD OF THE INVENTION

This invention relates to a method and apparatus for optimized log breakdown utilizing a rotatable bandmill or scragg saw according to an optimized profile as scanned and computed.

BACKGROUND OF THE INVENTION

In the prior art, logs are normally scanned and fed linearly through a double length infeed system to feed a bandmill or scragg saw for sawing into flitches and cants. The logs are scanned and rotated before they enter the double length infeed conveyor so that the logs are oriented with the horns down and or in a position to achieve maximum recovery. Once rotated, the logs enter the double length infeed conveyor one ahead of another. The logs are secured and fed towards the saws by a heavy duty lower chain and overhead press rolls within the double length infeed, where they are scanned and an optimizer/breakdown decision is made for the positioning of the chip head and saws.

In normal situations logs often are not always rotated exactly as would be optimal according to the optimizer decision. A loss of recovery results due to these small deviations in rotation. Consequently, in the prior art, a secondary scan is taken and then a minor rotation of the log is applied to correct the rotation so that a higher percentage of recovery may be achieved.

In particular, Applicant is aware of U.S. Pat. No. 5,918,653 to Knerr, which compensates for infeed rotational error by initially rescanning the log as the log passes through the double length infeed area and then attempting to compensate for any rotational error by slightly rotating the entire double length infeed in an attempt to optimize recovery.

The problem with this method is that when there are two shorter logs within the double length infeed at once, and the first log needs to be rotated, for example, 5 degrees and the second log needs to be rotated in the same direction of rotation a further 5 degrees for example and the combined 10 degrees of rotation exceeds the range of motion of the device. This results in a loss of recovery.

Thus it is an object of the present invention to improve recovery of the logs by rotating the bandmill or scragg saw, instead of the infeed, the small amount needed to correct the log orientation in order to maximize the recovery of each log.

SUMMARY OF THE INVENTION

The apparatus of the present invention is capable of correcting minor log rotational errors caused by an upstream autorotation device, by automatically rotating downstream saws as a single unit, immediately downstream of a double length infeed conveyor.

A linear scanner scans a log as the log moves linearly through the scanner on a V-flight chain. The log then moves linearly into position for autorotation in the autorotation device where the log is automatically rotated, usually so as to orient horns down as decided by an optimizer for optimized breakdown of the log using the scanner data and optimization software.

The log then moves linearly onto a stepped flight chain within the double length infeed conveyor, were the log is stablilized by over head press rolls pressing down on the stepped flight chain. The log is fed downstream along the infeed conveyor. A second scanner within the length of the double length infeed, re-scan the log for a final breakdown solution. Concurrently the optimizer also looks for higher recovery solutions at incremental angles. If a better solution at another angle is found, the saw unit , which may be dual or quad bandmills or a circular scragg saw, depending on the log size and breakdown requirements, will rotate to adjust its angular relation to the log by the optimized incremental angle as the log moves into position in front of the saw unit for sawing.

In summary, a rotatable saw unit of the present invention for optimized log breakdown of a log fed from an infeed conveyor includes a saw unit immediately downstream of an infeed conveyor and cooperating with the infeed conveyor for sawing a workpiece as the workpiece is translated by the infeed conveyor into the saw unit. The saw unit includes at least one saw aligned for sawing of the workpiece substantially parallel to a longitudinal or generally longitudinal infeed axis. An optimizing processor determines an optimized sawing orientation relative to the longitudinal infeed axis. A saw unit positioner selectively rotates the saw unit about a saw unit rotation axis so as to rotate the at least one saw into the optimized sawing orientation prior to sawing of the workpiece. The saw unit rotation axis is substantially parallel to the longitudinal infeed axis.

At least one scanner is positioned along the infeed conveyor for sensing orientation of the workpiece relative to the longitudinal infeed axis and for generating corresponding orientation data so that the optimizing processor may process the orientation data and determine the optimized sawing orientation.

The saw unit rotation axis may be adjacent the longitudinal infeed axis and may be co-axial with the longitudinal infeed axis. The at least one saw may be a band saw or a scragg saw, although this is not intended to be limiting. Alternatively, the at least one saw may be a pair of parallel bandsaws laterally spaced apart on either side of the saw unit rotation axis, and the corresponding planes are a pair of parallel planes corresponding to the pair of parallel band saws.

The saw unit may be at least one saw mounted on a corresponding at least one saw drive, wherein the at least one saw drive is mounted on a frame. Advantageously the frame is mounted on a base for selective rotational displacement relative to the base about the saw unit rotation axis by means of the saw unit positioner.

The saw unit positioner may include (a) rolling means mounted between the frame and the base, and (b) an actuator mounted to, so as to extend between, the frame and the base. The rolling means may include at least two rollers mounted in laterally spaced apart array to an underside of the frame for rolling cooperation over an arcuate track mounted on an upper surface of the base. Specifically, and without intending to be limiting, the rolling means may include first and second pairs of rollers, the first pair of rollers mounted on a first carriage pivotally mounted to a lower surface of the frame, and the second pair of rollers mounted on a second carriage pivotally mounted to the lower surface of the frame and laterally spaced apart from the first carriage, where the first and second pairs of rollers roll over and cooperate with an arcuate roller guide mounted on an upper surface of the base. The track or roller guide may be oriented laterally across the saw unit.

The invention provides other advantages which will be made clear in the description of the preferred embodiments.

DETAILED DESCRIPTION OF PREFERRED EMBODIMENTS

Figure 1:
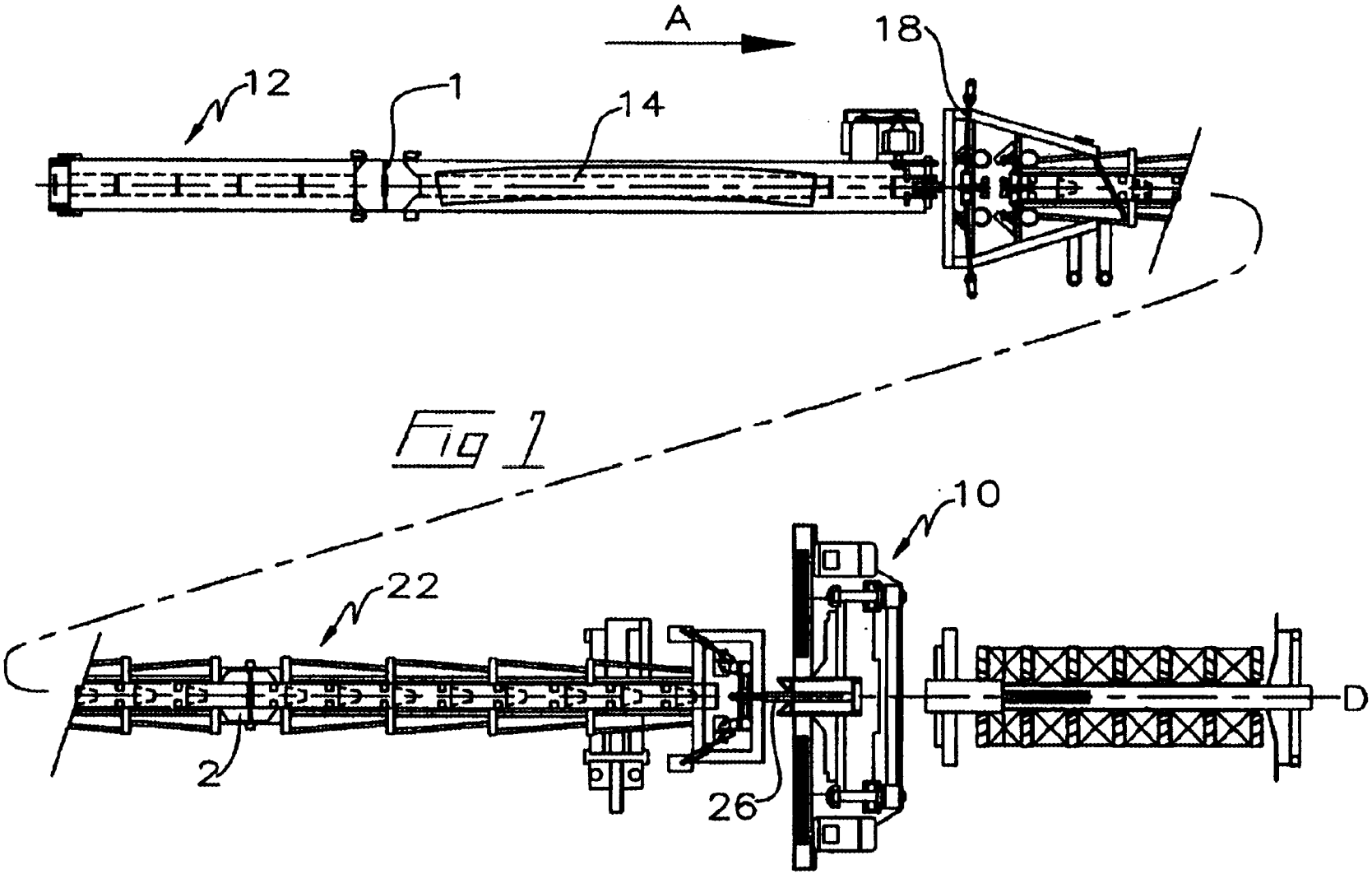
FIG. 1 is a plan view showing the sawing system of the present invention.

Referring to the drawing figures wherein similar characters of reference represent corresponding parts in each view, the rotating saw unit of the present invention is generally indicated by the reference numeral 10.

Figure 2:
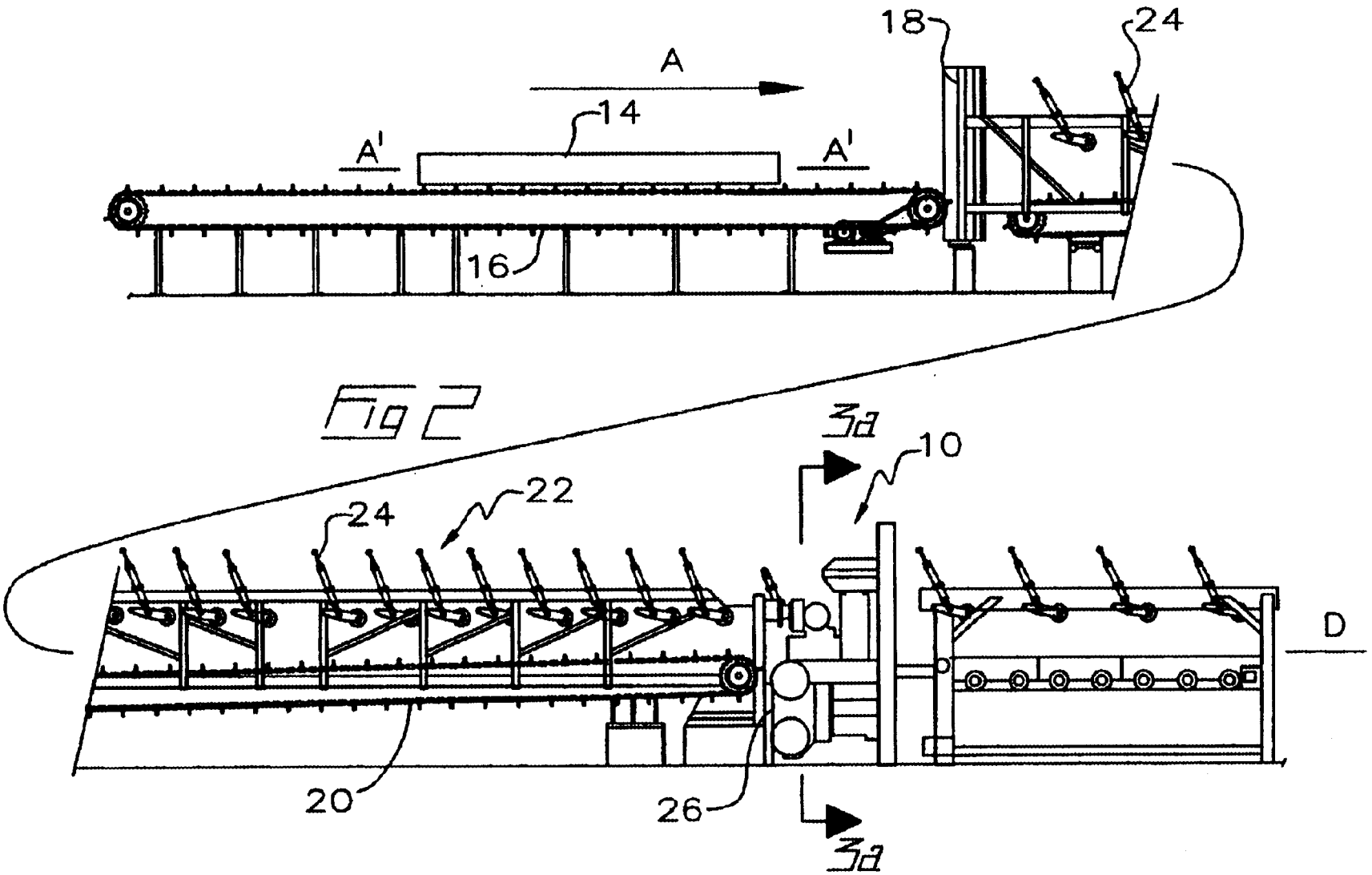
FIG. 2 is a side elevation view showing the sawing system of the present invention.

As best seen in FIGS. 1 and 2, linear scanner transfer 12 receives log 14 from the mill infeed in direction A. Log 14 has longitudinal axis A'. Linear scanner transfer 12 scans log 14 as the log 14 moves linearly through scanner 1 on a V-flight chain 16. Log 14 continues to move linely into log auto-rotator 18 located at the downstream end of scanner transfer 12. Auto-rotator 18 rotates log 14 automatically into its proper orientation for breakdown as log 14 continues to move linearly onto a stepped flight chain 20 and into double length infeed 22.

Within double length infeed 22, log 14 is fed downstream indirection A while being held stably by overhead press rolls 24 pressing down on to log 14 and stepped flight chain 20. Second scanner 2 is located along double length infeed 22. Log 14 is re-scanned by scanner 2 to check for a final sawing solution so that possibly a better sawing solution may be determined by the optimizer if saws 4 were rotated to a different angle.

Figure 3A:
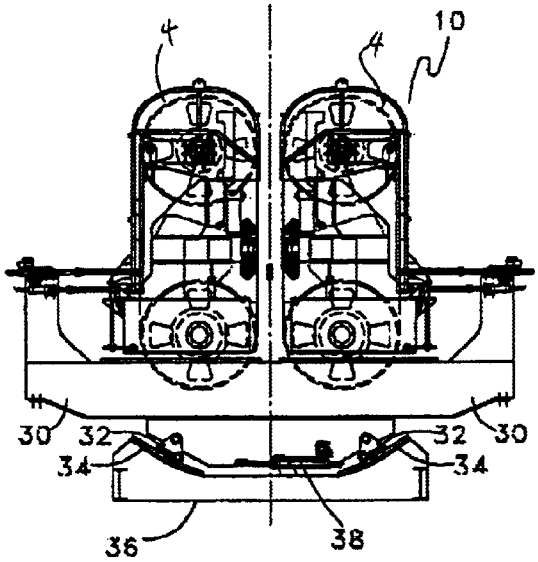
FIG. 3*a* is an elevation cross-sectional view of the sawing system of the present invention showing a dual bandmill unit, along section line 3*a*—3*a* in FIG. 2.
Figure 3B:
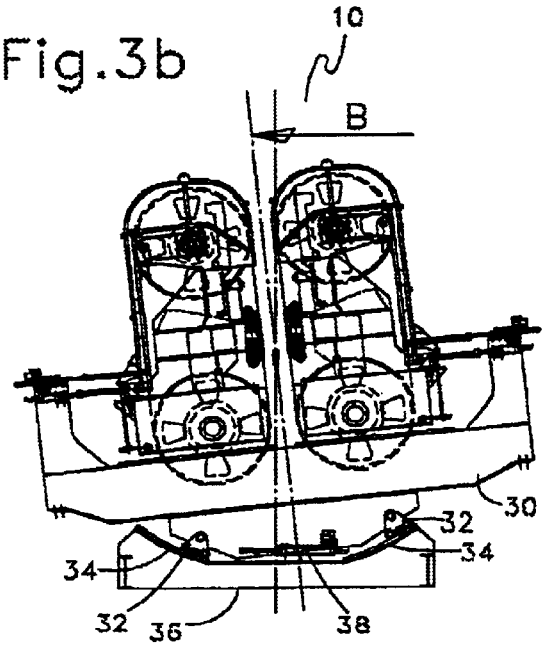
FIG. 3*b* is an elevation cross-sectional view of the sawing system of the present invention showing a dual bandmill unit rotated 6 degrees in direction B.
Figure 3C:
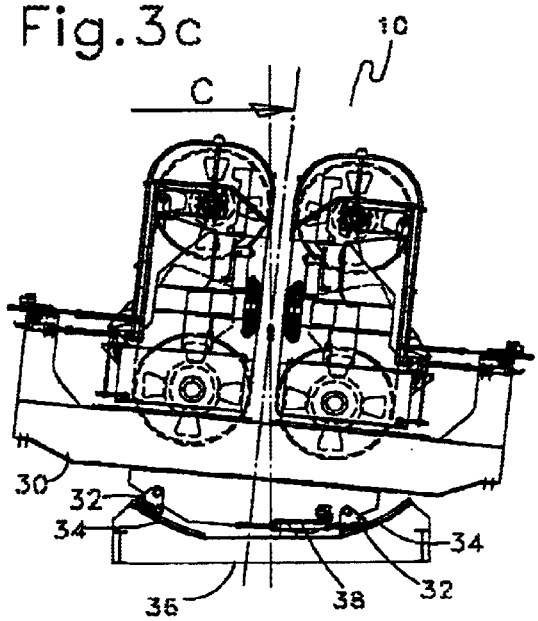
FIG. 3*c* is an elevation cross-sectional view of the sawing system of the present invention showing a dual bandmill unit rotated 6 degrees in direction C.

Log 14 then moves linearly from double length infeed 22 onto sharpchain 26 within saw unit 10. If, following rescanning by scanner 2, the optimizer decision is that a better optimized sawing solution may be obtained by rotating saws 10 relative to a longitudinal axis parallel to sharp chain 26, saw unit 10 is rotated as needed just prior to log 14 reaching band saws 4 within saw unit 10. As is best seen in FIGS. 3*a*, 3*b* or 3*c*, saw unit 10 may comprise a dual bandmill. Advantageously saw unit 10 may be rotated up to approximately five degrees in either direction B, or 5 degrees in direction C about axis D.

Figure 4A:
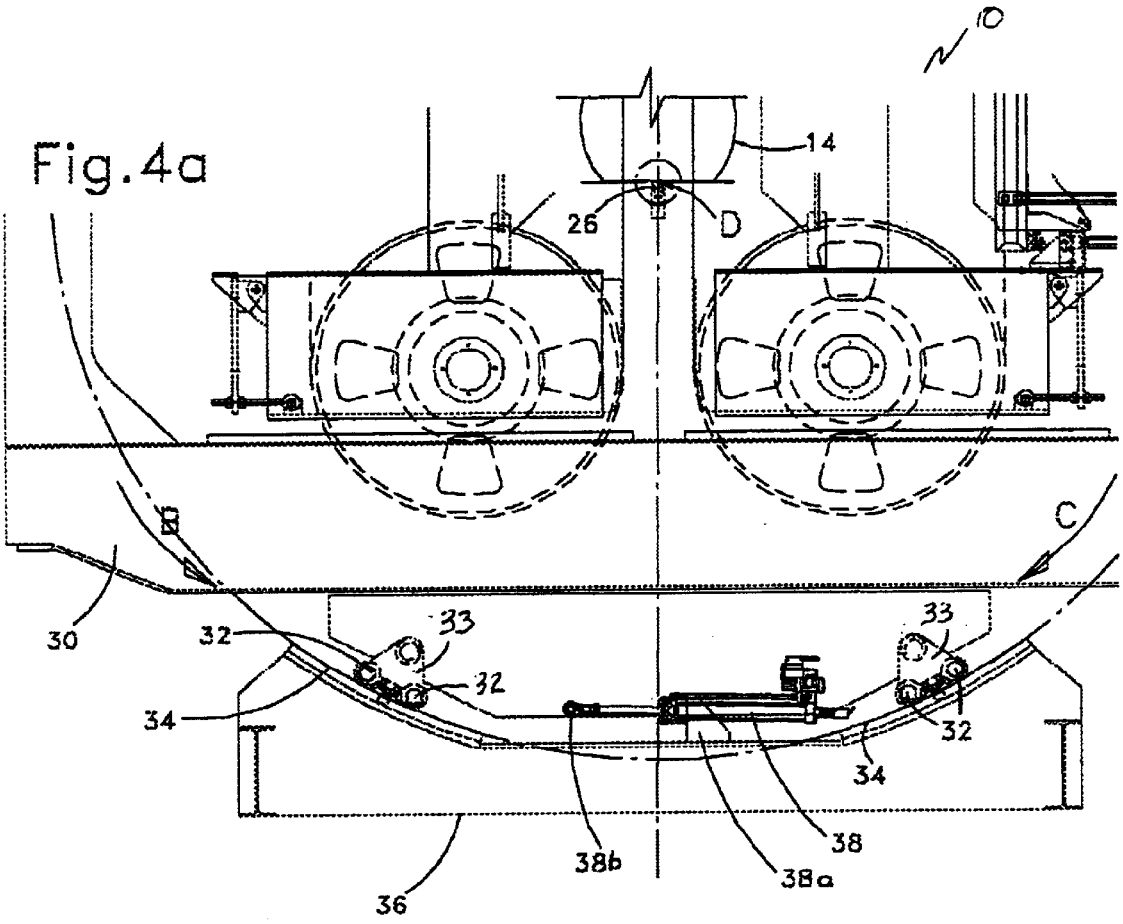
FIG. 4*a* is an elevation close-up view of the sawing unit of the present invention showing a close-up of the rotation tracks and rollers taken from FIG. 3*a*.
Figure 4B:
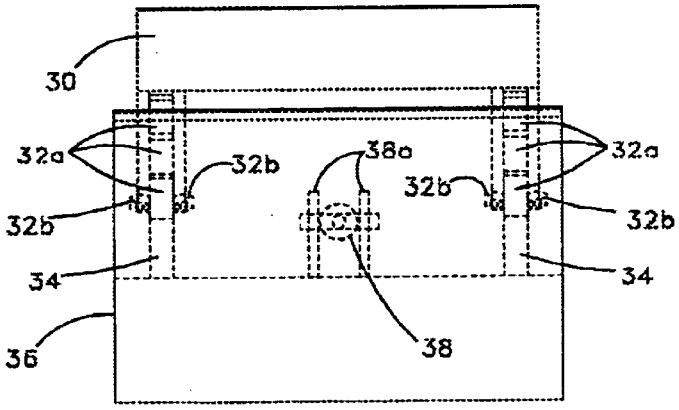
FIG. 4*b* is a side elevation close-up view close-up view of the saw rotation unit of the present invention showing a close-up of the rotation tracks and rollers in hidden lines.

As is best seen in FIGS. 4*a* and 4*b*, saw unit 10 is mounted on a frame 30. Frame 30 has at least four sets of rollers 32 mounted to its underside. Rollers 32 run on curved tracks 34. Curved tracks 34 are mounted on top of a base frame 36. Base frame 36 is securely fixed to the mill floor. Rotation of frame 30 relative to tracks 34 on base frame 36 is controlled by rotation cylinder 38. Rotational mount 38*a* is rigidly mounted to base frame 36. Cylinder 38 is mounted to mount 38*a*. The shaft end of cylinder 38 is mounted to frame 30 by pin 38*b*.

As seen in FIG. 4*b*, rollers 32 consist of main rollers 32*a* and side thrust rollers 32*b*. Main rollers 32*a* run on top of tracks 34. Side thrust rollers 32*b* run on the side of tracks 34.

Figure 5A:
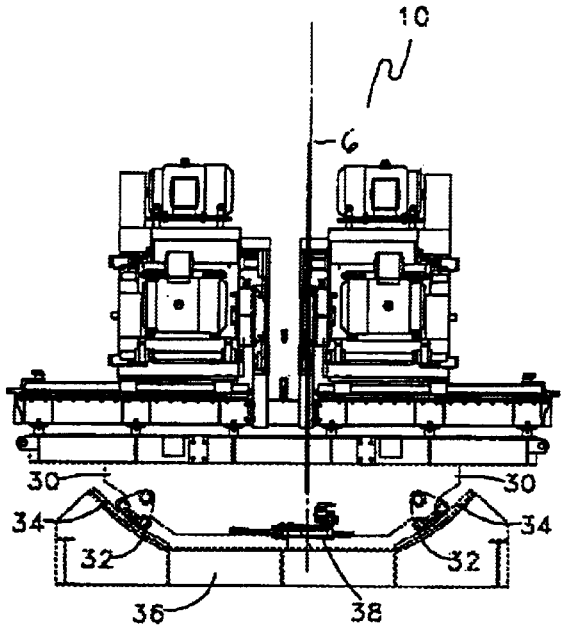
FIG. 5*a* is an elevation cross-sectional view showing a circular scragg saw unit.
Figure 5B:
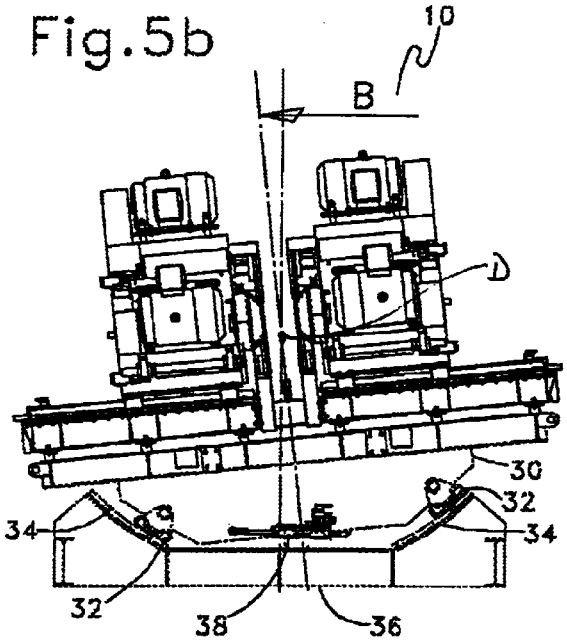
FIG. 5*b* is an elevation cross-sectional view showing a circular scragg saw unit rotated 6 degrees in direction B.
Figure 5C:
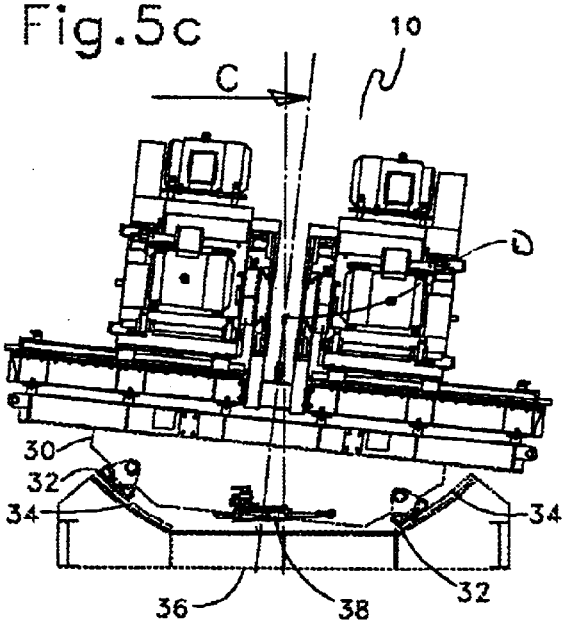
FIG. 5*c* is an elevation cross-sectional view showing a circular scragg saw unit rotated 6 degrees in direction C.

In a further embodiment, as is best seen in FIGS. 5*a*, 5*b* or 5*c*, saw unit 10 may be a circular scragg saw 6. Scragg saw 6 may rotate up to approximately 6 degrees in either direction B, or 6 degrees in direction C, it being understood that the rotational range of motion of either band saws 4 or scragg saws 6 are not intended to be limiting.

The center of rotation of saw unit 10, that is, axis D is located immediately below and in the center of sharp chain 26, where log 14 moves through saw unit 10. The location of the center of rotation allows the saws to be properly positioned when rotating saw unit 10 for the optimized breakdown of the log, whether the log is of large or small diameter.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A rotatable saw unit for optimized log breakdown of a workpiece fed from an infeed conveyor comprising:

a saw unit immediately downstream of said infeed conveyor cooperating with said infeed conveyor for sawing said workpiece as said workpiece is translated by said infeed conveyor into said saw unit, said saw unit including at least one saw aligned for said sawing of said workpiece in at least one plane corresponding to said at least one saw and generally parallel to a longitudinal infeed axis of said infeed conveyor, said infeed conveyor for translating said workpiece in a downs direction along said longitudinal infeed axis, said workpiece lying on said infeed conveyor substantially parallel to said longitudinal infeed axis, at least one scanner positioned along said infeed conveyor for sensing orientation of said workpiece relative to said longitudinal infeed axis and for generating corresponding orientation data, an optimizing processor for processing said orientation data and for determining an optimized sawing orientation of said at least one plane relative to said longitudinal infeed axis, a saw unit positioner for selective rotating of said saw unit about a saw unit rotation axis so as to rotate said at least one saw into said optimized sawing orientation prior to said sawing of said workpiece for sawing of said workpiece in said optimized sawing orientation, wherein said saw unit rotation axis is co-axial with said longitudinal infeed axis.

2. The rotatable saw unit of claim 1 wherein said at least one saw is a band saw.

3. The rotatable saw unit of claim 1 wherein said at least one saw is a scragg saw.

4. The rotatable saw unit of claim 1 wherein said at least one saw is a pair of parallel bandsaws laterally spaced apart on either side of said saw unit rotation axis, and wherein said at least one plane is a pair of parallel planes corresponding to said pair of parallel band saws.

5. The rotatable saw unit of claim 1 wherein the workpieces are uncanted logs, and further comprising a log rotator downstream of a first scanner of said at least one scanner, and a second scanner of said at least one scanner downstream of said log rotator for re-scanning a log following rotation by said log rotator, wherein said log rotator orients the log for breakdown by said saw unit, and wherein said saw unit positioner may rotate said saw unit in incremental angles about said saw unit rotation axis according to a final breakdown solution from said optimizing processor for higher recovery from the log.

6. The rotatable saw unit of claim 5 wherein said infeed conveyor includes a double length infeed conveyor upstream and adjacent said saw unit, and wherein said second scanner is mounted adjacent said double length infeed conveyor.

7. The rotatable saw unit of claim 1 wherein said saw unit comprises said at least one saw mounted on a corresponding at least one saw drive, and wherein said at least one saw drive is mounted on a frame, and wherein said frame is mounted on, for selective rotational displacement about said saw unit rotation axis by means of said saw unit positioner relative to, a base.

8. The rotatable saw unit of claim 7 wherein said saw unit positioner comprises:

(a) rolling means mounted between said frame and said base, and (b) an actuator mounted to, so as to extend between, said frame and said base.

9. The rotatable saw unit of claim 8 wherein said rolling means include at least two rollers mounted in laterally spaced apart array to an underside of said frame for rolling cooperation over an arcuate track mounted on an upper surface of said base.

10. The rotatable saw unit of claim 9 wherein said track is oriented laterally across said saw unit.

11. The rotatable saw unit of claim 8 wherein said rolling means include first and second pairs of rollers, said first pair of rollers mounted on a first carriage pivotally mounted to a lower surface of said fame and said second pair of rollers mounted on a second carriage pivotally mounted to said lower surface of said frame and laterally spaced apart from said first carriage, said first and second pairs of rollers for rolling cooperation over an arcuate roller guide mounted on an upper surface of said base.

12. The rotatable saw unit of claim 11 wherein said roller guide is oriented laterally across said saw unit.

13. A rotatable saw unit for optimized log breakdown of a workpiece fed from an infeed conveyor comprising:

a saw unit immediately downstream of said infeed conveyor cooperating with said infeed conveyor for sawing said workpiece as said workpiece is translated by said infeed conveyor into said saw unit, said saw unit including at least one saw aligned for said sawing of said workpiece in at least one plane corresponding to said at least one saw and generally parallel to a longitudinal infeed axis of said infeed conveyor, said infeed conveyor for translating said workpiece in a downstream direction along said longitudinal infeed axis, said workpiece lying on said infeed conveyor substantially parallel to said longitudinal infeed axis, at least one scanner positioned along said infeed conveyor for sensing orientation of said workpiece relative to said longitudinal infeed axis and for generating corresponding orientation data, an optimizing processor for processing said orientation data and for determining an optimized sawing orientation of said at least one plane relative to said longitudinal infeed axis, a saw unit positioner for selective rotating of said saw unit about a saw unit rotation axis so as to rotate said at least one saw into said optimized sawing orientation prior to said sawing of said workpiece for sawing of said workpiece in said optimized sawing orientation, wherein said saw unit rotation axis is substantially parallel to said longitudinal infeed axis, wherein the workpieces are uncanted logs and further comprising a log rotator downstream of a first scanner of said at least one scanner, and a second scanner of said at least one scanner downstream of said log rotator for re-scanning a log following rotation by said log rotator, wherein said log rotator orients the log for breakdown by said saw unit, and wherein said saw unit positioner may rotate said saw unit in incremental angles about said saw unit rotation axis according to a final breakdown solution from said optimizing processor for higher recovery form the log.

14. The rotatable saw unit of claim 13 wherein said infeed conveyor includes a double length infeed conveyor upstream and adjacent said saw unit, and wherein said second scanner is mounted adjacent said double length infeed conveyor.

* * * * *